US012767399B2

(12) United States Patent
Turner et al.

(10) Patent No.: US 12,767,399 B2
(45) Date of Patent: Oct. 20, 2026

(54) SAFETY CAP ASSEMBLY WITH AIR PASSAGE TO PREVENT SUFFOCATION

(71) Applicant: ORALABS, Inc., Parker, CO (US)

(72) Inventors: Chris P. Turner, Parker, CO (US); Gary Schlatter, Parker, CO (US)

( * ) Notice: Subject to any disclaimer, the term of this patent is extended or adjusted under 35 U.S.C. 154(b) by 279 days.

(21) Appl. No.: 18/322,333

(22) Filed: May 23, 2023

(65) Prior Publication Data

US 2024/0391662 A1 Nov. 28, 2024

(51) Int. Cl.
*B65D 51/16* (2006.01)
*B65D 50/04* (2006.01)

(52) U.S. Cl.
CPC ..... *B65D 51/16* (2013.01); *B65D 50/046* (2013.01); *B65D 2205/02* (2013.01)

(58) Field of Classification Search
CPC ..... B65D 50/041; B65D 2215/02; B65D 2205/02; B65D 2205/00; B65D 51/16; B65D 50/046
USPC ..... 215/217, 219, 230, 220, 201; 220/360
See application file for complete search history.

(56) References Cited

U.S. PATENT DOCUMENTS 5,115,929 A * 5/1992 Buono ..... B65D 50/041 215/230
5,299,701 A * 4/1994 Barker ..... G06M 1/248 215/218
5,638,970 A * 6/1997 Garby ..... G06M 1/248 215/230
6,003,467 A * 12/1999 Shelton-Ferrell ..... G09F 11/23 116/315
8,443,999 B1 * 5/2013 Reinders ..... B65D 41/3409 215/253
8,474,634 B1 * 7/2013 Branson ..... B65D 50/041 215/230
8,579,140 B2 * 11/2013 Delagrange ..... B65D 50/065 215/221

(Continued)

FOREIGN PATENT DOCUMENTS

DE 29609596 U1 12/1996
WO 2013190723 A1 12/2013

*Primary Examiner* — Prince Pal
(74) *Attorney, Agent, or Firm* — WELSH FLAXMAN & GITLER LLC

(57) ABSTRACT

A safety cap assembly including an over cap and a screw cap secured within the over cap. The over cap having a plurality of spaced downward lugs extending downward from the top wall of the over cap and the screw cap having a plurality of spaced upward lugs extending from the upper wall of the screw cap which correspond with the downward lugs in the over cap. The over cap has a plurality of spaced air passages passing through the top wall of the over cap. The screw cap has a side wall with internal threads and an air passageway that extends through the side wall and does not interfere with the internal threads. The air passageway in the screw cap is in fluid communication with the plurality of air passages in the over cap such that should the safety cap assembly be swallowed suffocation is prevented. Further, when the over cap is sufficient depressed and turned the downward lugs will engage the upward lugs and the safety cap assembly can be removed from a thread container and if the over cap is not sufficient depressed the downward lugs will slide over the upward lugs and the safety cap assembly cannot be removed.

6 Claims, 6 Drawing Sheets

(56) References Cited

U.S. PATENT DOCUMENTS 8,807,361 B2 * 8/2014 Luo ..... B65D 55/00 220/265
9,492,356 B2 * 11/2016 Balakier ..... A61J 7/04
9,617,045 B2 * 4/2017 Reinders ..... B65D 41/3409
10,266,317 B1 * 4/2019 Bores ..... B65D 51/1683
10,676,256 B2 * 6/2020 Faragher ..... B65D 50/041
10,842,717 B2 * 11/2020 Gosselin ..... A61J 1/1418
11,628,123 B2 * 4/2023 Chambers ..... A61J 1/03 206/534
11,873,146 B1 * 1/2024 Gonzalez ..... B65D 83/0409
12,006,110 B2 * 6/2024 Bois ..... B65D 41/005
2002/0000908 A1 * 1/2002 Burg, II ..... G08B 3/10 206/217
2008/0149638 A1 * 6/2008 Van Hees ..... B65D 47/265 220/360
2010/0147732 A1 * 6/2010 Delagrange ..... B65D 50/041 215/221
2010/0264108 A1 * 10/2010 Baban ..... B65D 55/022 215/230
2013/0112648 A1 * 5/2013 Cohen ..... B65D 77/225 215/307
2015/0298869 A1 * 10/2015 Browne ..... B65D 41/3447 215/252
2016/0130043 A1 * 5/2016 Zhong ..... B65D 41/3409 220/288
2016/0251127 A1 * 9/2016 Faragher ..... B65D 50/041 215/217
2018/0251275 A1 * 9/2018 LaPierre ..... B65D 47/32
2019/0075908 A1 * 3/2019 Schlatter ..... A45D 40/06
2019/0185249 A1 * 6/2019 Bartley ..... B65D 47/265
2019/0233184 A1 * 8/2019 Arminak ..... B65D 51/245
2021/0171249 A1 * 6/2021 Aboabdo ..... B65D 1/0246
2021/0179323 A1 * 6/2021 Kreinbrink ..... B65D 50/041
2021/0206551 A1 * 7/2021 Nollman ..... B65D 55/10
2022/0041350 A1 * 2/2022 Berge ..... B65D 50/041
2023/0119991 A1 * 4/2023 Lei ..... B65D 50/041 220/298
2023/0174365 A1 * 6/2023 Johnson ..... B01D 27/08 210/767
2023/0312194 A1 * 10/2023 Dhawan ..... B65D 50/041 215/217
2024/0076107 A1 * 3/2024 Oostveen ..... B65D 77/225
2024/0199290 A1 * 6/2024 Ubell ..... B65D 50/041
2024/0391662 A1 * 11/2024 Turner ..... B65D 50/046

* cited by examiner

SAFETY CAP ASSEMBLY WITH AIR PASSAGE TO PREVENT SUFFOCATION

BACKGROUND OF THE INVENTION

1. Field of the Invention

The present invention relates to a safety cap assembly for threaded mouth containers, which is designed to prevent young children from accidentally ingesting harmful substances, such as medicine, household chemicals, and other hazardous materials. Additionally, the safety cap assembly is designed to prevent suffocation incidents by providing air passages in the cap should the cap be swallowed.

2. Description of the Related Art

Suffocation can be a significant hazard associated with bottle caps, particularly for young children and infants. Children can accidentally place the cap in their mouths, blocking their airways and causing suffocation. Therefore, there is a need for a safety cap, which does not pass the choking tube test and that prevents suffocation incidents should the cap be swallowed. A choking tube test involves the use of a cylindrical having an interior diameter of 1.25 inches and a slanted bottom with a depth of 2.25 inches. That's about the size of a 3-year-old's throat. If an object fits entirely within the tube, then it's a choking hazard.

Additionally, the ingestion of harmful substances is a serious problem that poses a significant risk to young children's health and safety. Every year, thousands of children are hospitalized due to accidental poisoning, and some cases result in fatalities.

These incidents occur when children can easily gain access to containers of medicine, cleaning supplies, and other hazardous materials by simply unscrewing the cap from the container containing such hazardous materials. While child-resistant packaging has been developed to address this issue, they have not taken into consideration the possibility of the cap being swallowed once removed.

Therefore, there is a need for a child safety cap assembly that is easy to use for adults but difficult for young children to open and, once the cap is removed, does not present issues with suffocation if accidentally swallowed.

SUMMARY OF THE INVENTION

It is, therefore, an object of the present invention to provide a safety cap assembly for a threaded container which prevent suffocating if swallowed and requires depressing and turning in order to be removed from the threaded container. The safety cap assembly having an over cap including an upper wall with an upper and lower surface with a plurality of spaced air passages passing from the upper surface to the lower surface of the upper wall and at least one downward lug extending downward from the lower surface, and a side wall extending downward from the upper wall with an internal circumferential recess and a screw cap including a top wall with a top and bottom surface with at least one upward lug extending from the top surface of the top wall which correspond with the downward lugs in the over cap, and a side wall having internal threads, an external circumferential projection and an air passageway which extends through the side wall and does not interfere with the internal threads. The external circumferential projection of the screw cap is secure within the internal circumferential recess of the over cap such that the screw cap and the over cap can rotate relative to one another. The air passageway in the screw cap is in fluid communication with the plurality of air passages in the over cap such that should the safety cap assembly be swallowed suffocation is prevented. Further, when the over cap is sufficient depressed and turned the at least one downward lug will engage the at least one upward lug and the safety cap assembly can be removed from the thread container and if the over cap is not sufficient depressed the at least one downward lug will slide over the at least one upward lug and the safety cap assembly cannot be removed.

It is another object to provide a safety cap assembly having a first channel located between the sidewall of the over cap and sidewall of the screw cap and a second channel located between the lower surface of the upper wall of the over cap and the top surface of the top wall of the screw cap that provide fluid communication between the plurality of air passages in the over cap and the air passageway in the screw cap.

It is another object to provide air passages in the over cap in the shape of arrows to indicate the direction the safety cap assembly needs to be turned for removal.

It is another object to provide a safety cap assembly wherein the at least one downward lug and the at least one upward lug include angled surfaces that frictional cooperate with each other for removal of the safety cap from the threaded container. It is another object to provide a safety cap assembly wherein the at least one downward lug includes a flat surface which lies in a plane perpendicular to the lower surface of the over cap and opposed to the angled surface and the at least one upward lug includes a flat surface which lies in a plane perpendicular to the top surface of the screw cap and opposed to angled surface.

It is another object to provide an over cap with a plurality of spaced downward lugs and a screw cap with a plurality of spaced upward lugs.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
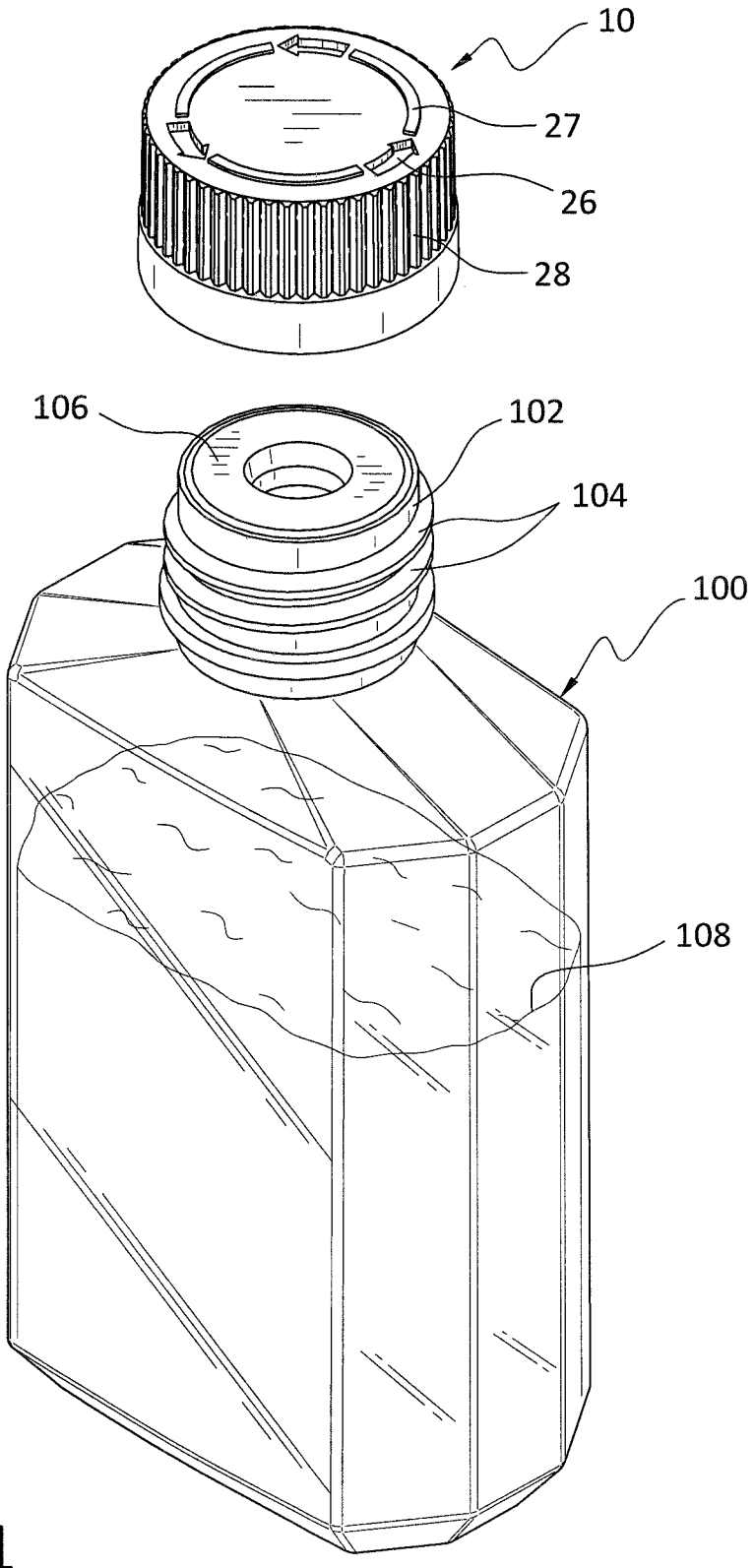
FIG. 1 shows a perspective view of a container with the safety cap assembly removed to expose the threaded mouth and allow access to the ingredients of the container.
Figure 2:
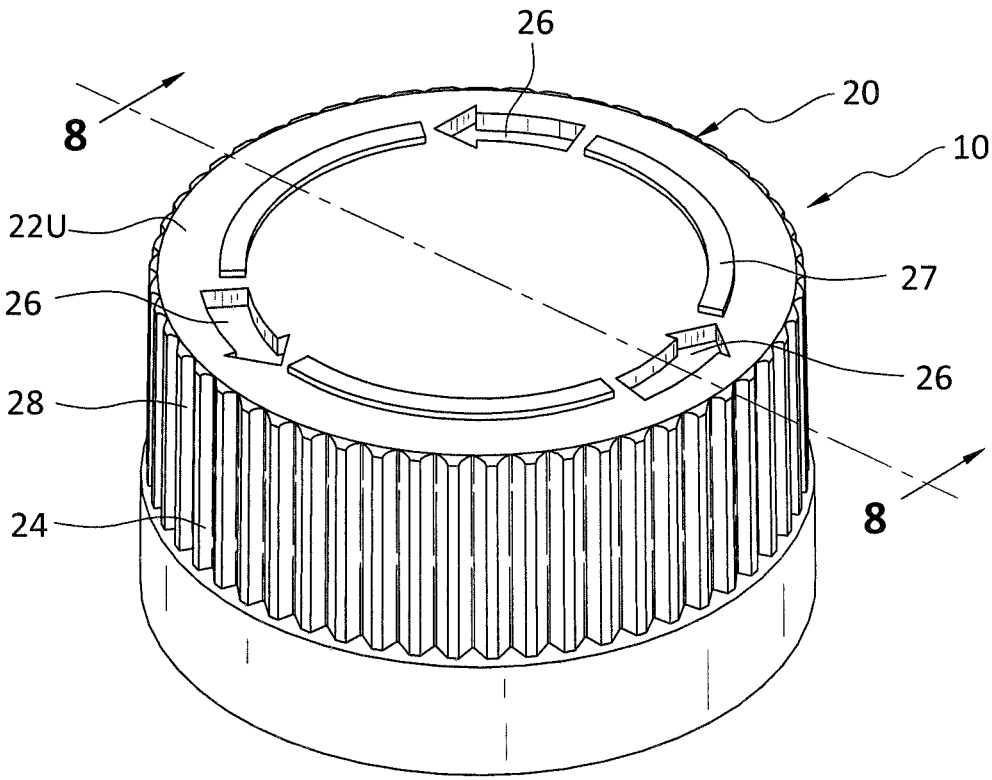
FIG. 2 shows a top perspective view of the safety cap assembly.
Figure 3:
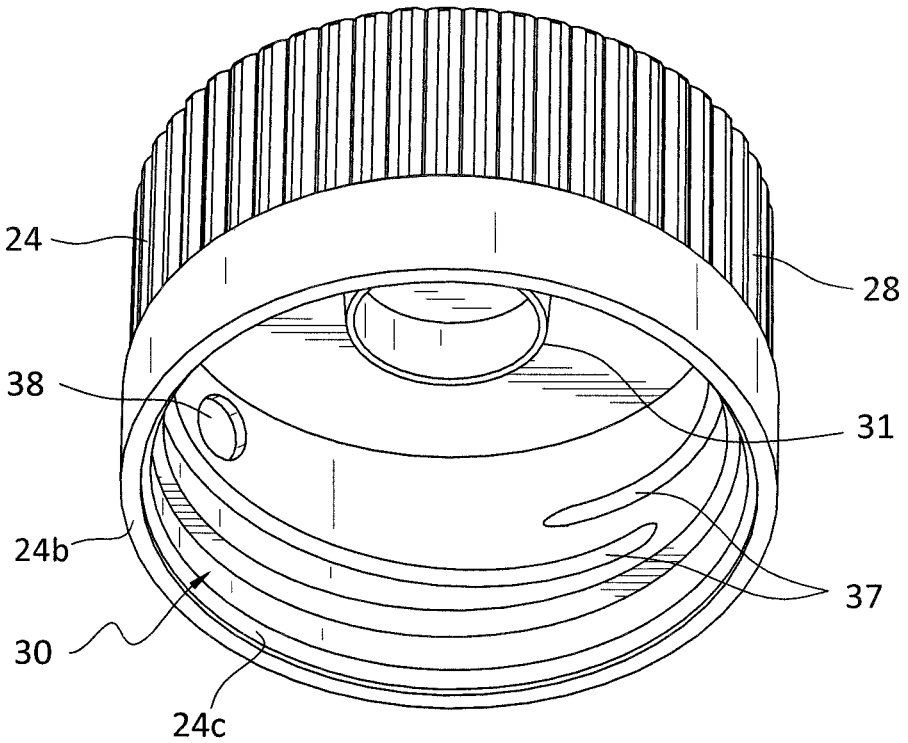
FIG. 3 shows a bottom perspective view of the safety cap assembly.

A safety cap assembly 10 in accordance with the present invention is shown in FIGS. 1-9. The safety cap assembly 10 is used in cooperation with a threaded container 100 having a mouth 102 with external threads 104 as shown in FIG. 1. The mouth 102 further includes a dispensing valve 106 positioned internally for controlled dispensing of ingredients 108. The threaded container 100 is a clear bottle with colorful ingredients 108 which children would naturally be attracted to. In particular, the ingredients comprise a concentrated mouth wash. However, the bottle could include a variety of ingredients.

As will be discussed below in greater detail, the safety cap assembly 10 is structured to prevent suffocation if swallowed and requires depressing and turning in order to be removed from the threaded container. The safety cap assembly 10 is formed from two pieces, an over cap 20 and a screw cap 30. The over cap 20 includes a plurality of spaced air passages 26 and a plurality of spaced downward lugs 23. The screw cap 30 includes a plurality of spaced upward lugs 33 which correspond with the downward lugs 23 in the over cap 20 and an air passageway 38. A first channel 40 and second channel 42 exist between the over cap 20 and screw cap 30. The first channel 40 and second channel 42 provide fluid communication between the plurality of air passages 26 in the over cap 20 and the air passageway 38 in the screw cap 30 such that should the safety cap assembly be swallowed suffocation is prevented.

The over cap 20 includes a circular upper wall 22 having an upper surface 22U and a lower surface 22L. Extending circumferentially downward from the upper wall 22 is a side wall 24 having an external surface 24*e*, an internal surface 24*i*, and a bottom 24*b*. The internal surface 24*i* includes a circumferential recess 25 defined by a sloped upper wall 25*u* and a circumferential curved projection 24*c* located adjacent the bottom 24*b*. The external surface 24*e* includes ribs 28 about the circumference permitting the over cap 20 to be securely gripped.

The upper wall 22 of the over cap 20 includes a plurality of air passages 26 in the shape of arrows. The air passages 26 are in the form of openings which extend from the upper surface 22U to the lower surface 22L. The air passages 26 are shaped as arrows as they also serve as indicators, to indicate the direction the safety cap assembly 10 needs to be turned in order for the safety cap assembly 10 to be removed from the threaded container 100. The upper surface 22U also includes curved projections 27 between the air passages 26. The curved projections 27 follow the path of the arrow shaped air passages 26 to further highlight the direction of the arrows and function to prevent divots from forming between the arrow shaped air passages 26 during the molding and cooling process of the over cap 20.

The lower surface 22L of the over cap 20 includes at least one downward lug 23 extending towards a top surface 32*t* of top wall 32 of the screw cap 30 (discussed below in detail). In the present exemplary embodiment, the over cap 20 has six downward lugs 23 oriented in a circle along the lower surface 22L of the over cap 20. Each of the downward lugs 23 includes a forward on drive surface 23*f* and a rearward selective drive surface 23*r* which is opposite the forward on drive surface 23*f*. The forward on drive surface 23*f* is flat and lies in a plane perpendicular to the lower surface 22L of the over cap 20. The rearward selective drive surface 23*r* is angled and lies in a plane oblique to the lower surface 22L of the over cap 20 (preferably oriented at an angle between 45 to 60 degrees relative to the lower surface 22L of the over cap 20. The operation of the drive surfaces 23*f* and 23*r* will be discussed below in more detail below.

The screw cap 30 includes a circular top wall 32 having a top surface 32*t* and a bottom surface 32*b*. Extending circumferentially downward from the top wall 32 is a side wall 34 having an external surface 34*e*, an internal surface 34*i*, and a bottom 34*b*. The external surface 34*e* includes a circumferential projection 35 adjacent to the bottom 34*b*. The circumferential projection 35 includes a sloped upper wall 35*u*. The internal surface 34*i* includes internal threads 37 which cooperate with the external threads 104 on the mouth 102 of container 100. The side wall 34 further includes an air passageway 38 in the shape of a circle. The diameter of the air passageway 38 is no less than 3.5 mm. The air passage 38 in the screw cap 30 is located in the side wall 34 such that it does not interfere with the internal threads 37. The air passageway 38 is in the form of an opening which extend from the internal surface 34*i* to the external surface 34*e*. The screw cap 30 further includes a valve cover 31 which extends into and covers the dispensing valve 106 when the safety cap assembly 10 is fastened to the threaded container 100.

The top surface 32*t* of the screw cap 30 is suitably configured with at least one upward lug 33 extending towards the lower surface 22L of the over cap 20. In the present exemplary embodiment, the screw cap 30 has six upward lugs 33, oriented in a circle, which cooperate with the downward lugs 23 formed in the over cap 20. Each of the upward lugs 33 include a rearward on drive surface 33*r* and a forward selective drive surface 33*f* which is opposite the rearward on drive surface 33*r*. The rearward on drive surface 33*r* is flat and lies in a plane perpendicular to the top surface 32*t* of the screw cap 30. The forward selective drive surface 33*f* is angled and lies in a plane oblique to the top surface 32*t* of the screw cap 30. The operation of the drive surfaces 33*f* and 33*r* will be discussed below in more detail below.

Preferably, the over cap 20 is configured with the same number of downward lugs 23 as the screw cap 30 has upward lugs 33, though any number or configuration of the downward lugs 23 and the upward lugs 33 may be suitable. The downward lugs 23 are suitably located to correspond and engage with the upward lugs 33. The upward lugs 33 are located annularly at evenly spaced intervals, in proximity to outer edge of top surface 32*t* of the screw cap 30. Accordingly, the downward lugs 23 should similarly be located as such to correspond to the upward lugs 33, that is, annularly at evenly spaced intervals, in proximity to an outer edge of lower surface 22L of upper wall 22 of the over cap 20.

The over cap 20 and the screw cap 30 are connected to one another and work together to require a combination of simultaneous actions, i.e., depressing and turning, in order for the safety cap assembly 10 to be removed from the threaded container 100. Both pieces of the safety cap assembly 10 are made from plastic. The over cap 20 is attached to the screw cap 30 by inserting screw cap 30 within the over cap 20 and forcing the over cap 20 down over screw cap 30 until the external projection 35 on the screw cap 30 resides in the recess 25 in the over cap 20. Due to the shape of the curved projection 24*c* it will slide over the upper surface 35*u* of the projection 35 as the over cap 20 is forced over the screw cap 30 resulting in the projection 35 on the screw cap 30 residing in the recess 25 in the over cap 20.

Once the external projection 35 is positioned with the recess 25, the screw cap 30 cannot be separated from the over cap 20 without damaging the screw cap 30. Thus, what is considered to be a permanent connection is formed between the over cap 20 and the screw cap 30 to form the safety cap assembly 10. The external circumferential projection 35 of the screw cap 30 is free to move up and down within the internal circumferential recess 25 of the over cap 20.

In accordance with an exemplary embodiment of the present invention and as discussed above, the over cap 20 is suitably configured with at least one downward lug 23 extending downward from the lower surface 22L of upper wall 22 of the over cap 20 and the screw cap 30 is suitably configured with at least one upward lug 33 extending upward from the top surface 32*t* of the top wall 32 of the screw cap 30. The lugs 23 and 33 are suitably shaped to cooperate with one another during removal and securing of the safety cap assembly 10 to the container 100. The lugs 23, 33 are approximately 3 mm in length and 1 mm in height and include an angled selective drive surface and oppositely disposed flat on drive surface along their length. Preferably, the over cap 20 is configured with the same number of downward lugs 23 as the screw cap 30 has upward lugs 33 though any number or configuration of downward lugs 23 and upward lugs 33 may be suitable. In the present exemplary embodiment, the screw cap 30 has six upward lugs 33 and the over cap 20 is suitably configured with six downward lugs 23. The six downward lugs 23 are suitably located to correspond and engage with the six upward lugs 33. The six upward lugs 33 are located annularly at evenly spaced intervals, in proximity to outer edge of top surface 32*t* of the screw cap 30. Accordingly, the six downward lugs 23 are similarly located to correspond to the upward lugs 33, that is, annularly at evenly spaced intervals, in proximity to an outer edge of lower surface 22L of upper wall 22 of the over cap 20.

As briefly discussed above, each of the downward lugs 23 is configured with the selective drive surface 23*r* which is angled and an opposed on drive surface 23*f* which is flat and lies in a plane perpendicular to the lower surface 22L. In the present exemplary embodiment, the slope of the selective drive surface 23*r* of the downward lugs 23 suitably correspond to the slope of the selective drive surface 33*f* of the upward lugs 33 such that the downward lugs 23 and corresponding the upward lugs 33 engage by surface-to-surface contact when the over cap 20 is pressed downward. That is, throughout the relative rotation of the over cap 20 and the screw cap 30, the downward lugs 23 remain in contact with the upward lugs 33, not by merely point contact, but by radial contact across the corresponding slopes. Similarly, the flat on drive surface 33*r* of each of the upward lugs 33 corresponds to flat on drive surface 23*f* of each of the downward lugs 23.

Figure 8:
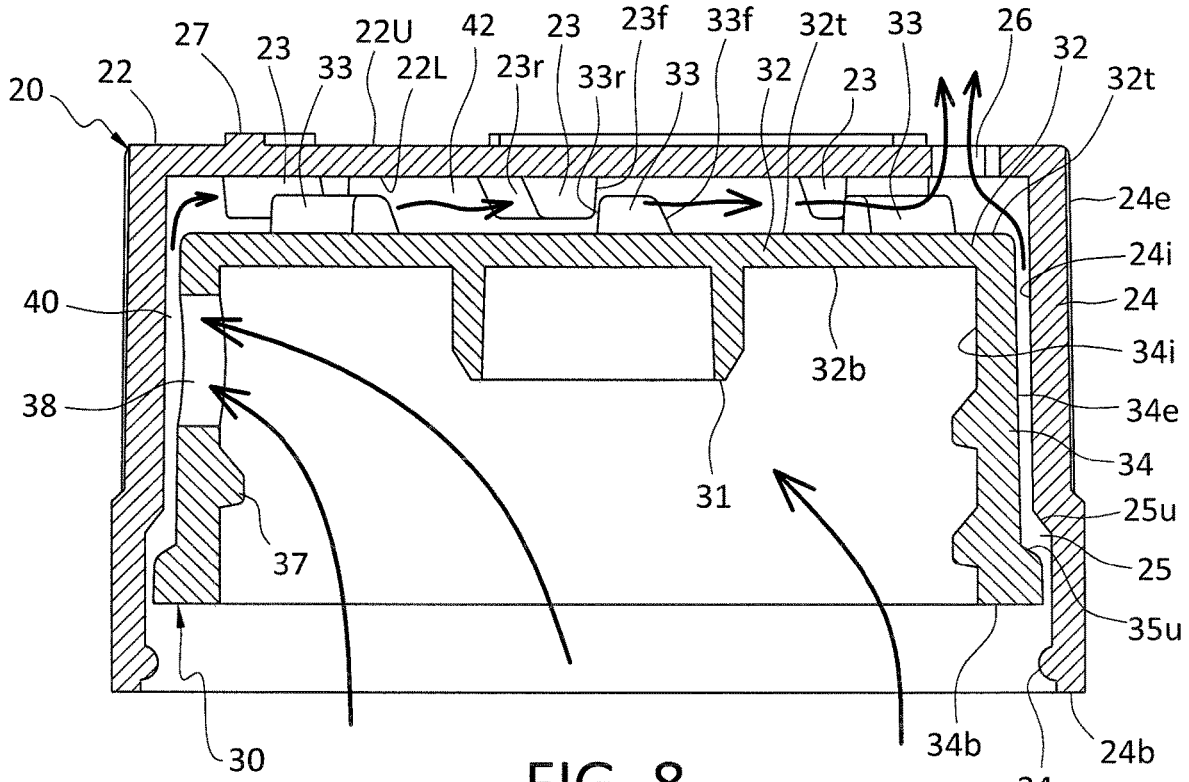
FIG. 8 shows a cross-sectional view of the safety cap assembly taken along line 8-8 shown in FIG. 2 showing the air flow through the air passages if the safety cap assembly was swallowed with the over cap facing up.
Figure 9:
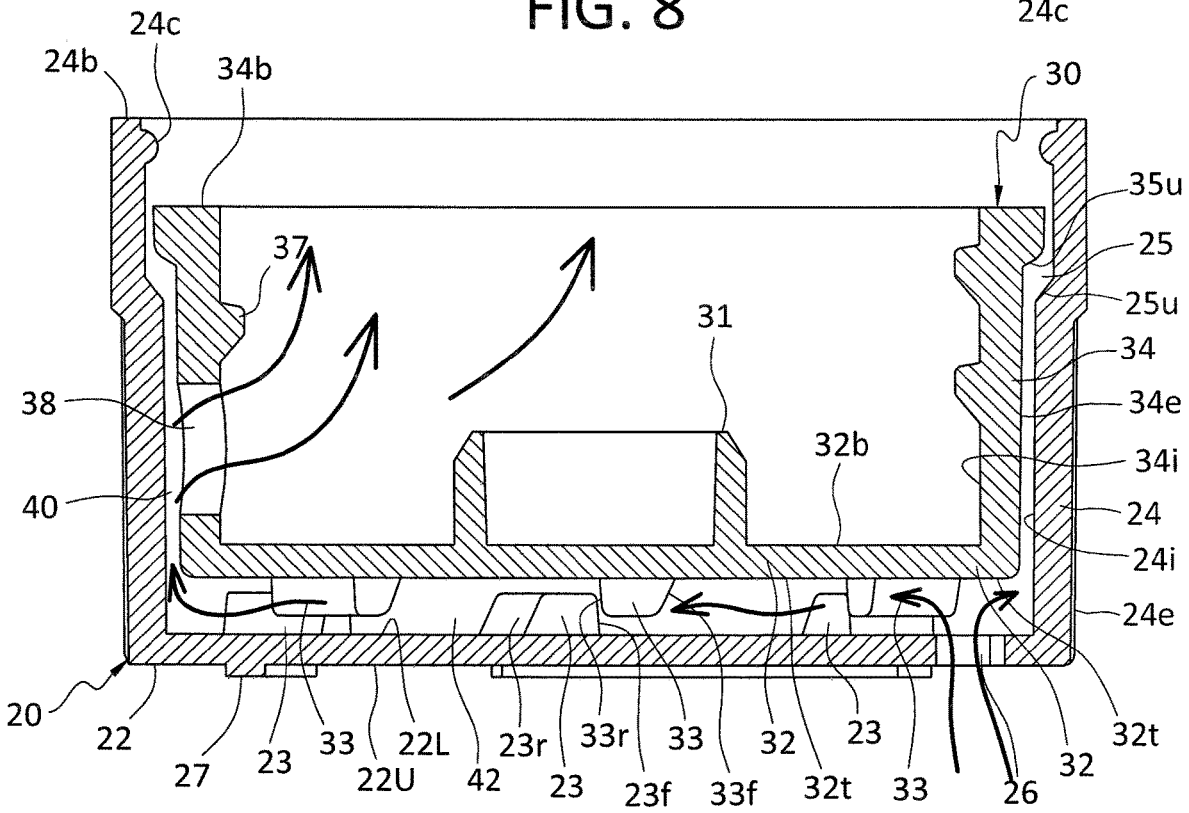
FIG. 9 shows a cross-sectional view of the safety cap assembly taken along line 8-8 shown in FIG. 2 showing the air flow through the air passages if the safety cap assembly was swallowed with the over cap facing down.

With reference to FIG. 8, the operation of the safety cap assembly 10 is as follows. As the over cap 20 is rotated in a clockwise direction or fastening direction, the over cap 20 begins to rotate freely relative to the screw cap 30. As the over cap 20 continues to rotate, the on drive surfaces 23*f* of the downward lugs 23 contact the on drive surfaces 33*r* of the upward lugs 33 in substantially flat surface-to-flat surface contact. Throughout the rotation of the over cap 20, the downward lugs 23 remain in flat surface-to-flat surface contact with the upward lugs 33 and the continued rotation causes internal threads 37 to intermesh with external threads 104 to secure the safety cap assembly 10 to the threaded container 100.

When the over cap 20 is rotated in a counterclockwise direction or unfastening direction, the over cap 20 rotates freely. When over cap 20 is merely rotated without downward pressure in the unfastening direction, due to the corresponding angled surfaces, the selective drive surfaces 23*r* of the downward lugs 23 slide over the respective drive surfaces 33*f* of the upward lugs 33. The screw cap 30 and the over cap 20 thus do not turn in tandem, and the safety cap assembly 10 remains fastened to the threaded container 100, thereby making the safety cap assembly 10 child resistant.

In order to remove the safety cap assembly 10, downward force is applied to the over cap 20 in order to counteract the sliding tendency of the downward lugs 23 over the upward lugs 33. That is, the selective drive surfaces 23*r* and 33*f* are forced into frictional contact and rotation of the over cap 20 causes the screw cap 30 to rotate in tandem with the over cap 20, thus unthreading the internal threads 37 of the screw cap 30 from the external threads 104 of the container 100 to remove the safety cap assembly 10 from the container 100. The angle of the selective drive surfaces of the downward lugs 23 and the upward lugs 33 can be adjusted to require more or less torque and/or downward force to remove the safety cap assembly 10 from the threaded container 100. The safety cap assembly 10 thus has the benefit that the safety cap assembly 10 can remain child resistant, yet is substantially more senior-friendly.

It should be noted, however, that many alternative embodiments of the safety cap assembly 10 which suitably provide for substantially radial contact between the over cap 20 and the screw cap 30 of the safety cap assembly 10 and suitably remain child resistant while remaining senior-friendly, may be apparent to one skilled in the art. All of such embodiments fall within the scope and spirit of the invention.

Figure 4:
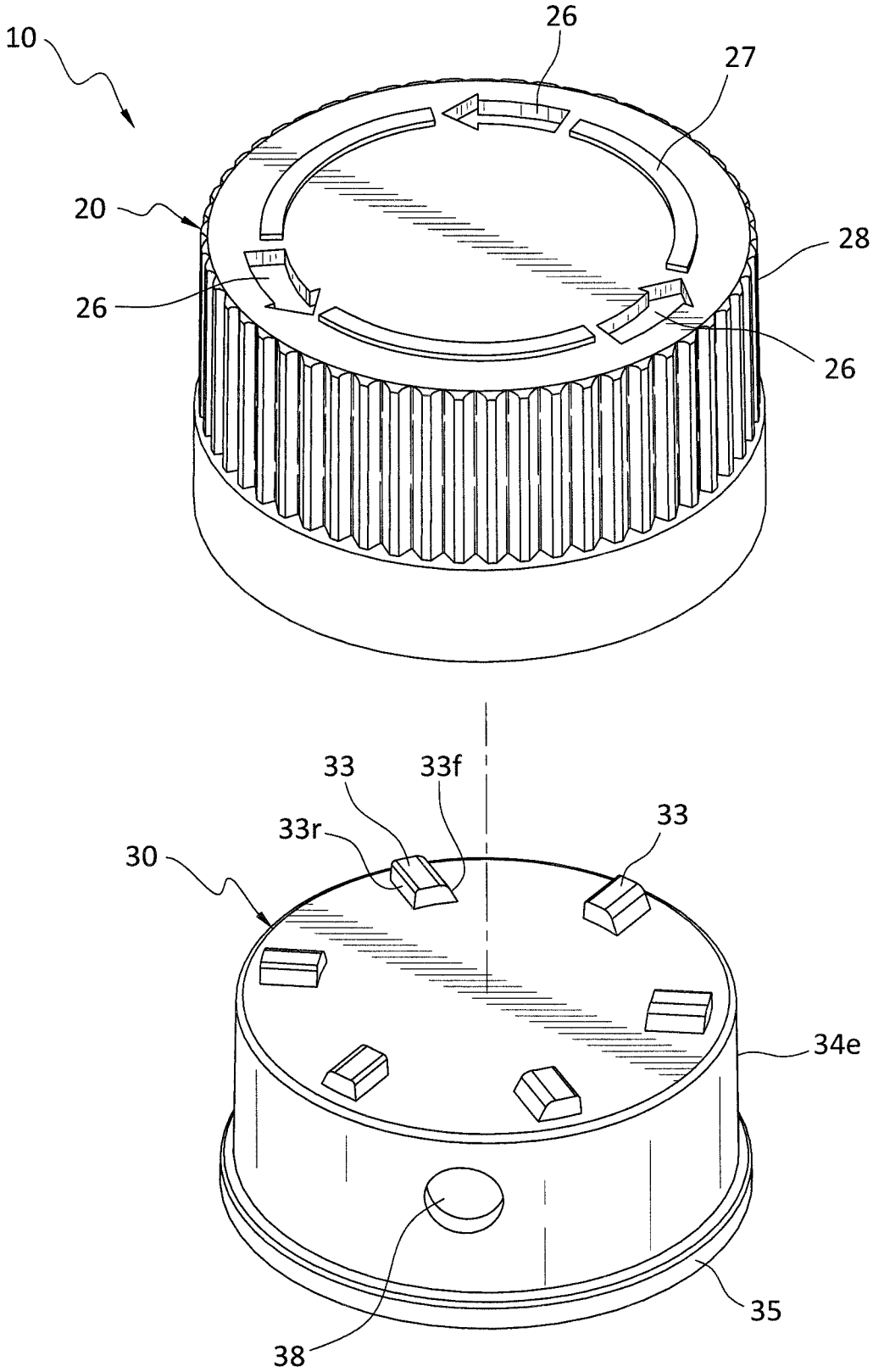
FIG. 4 shows an exploded view of an over cap and a screw cap which together form the safety cap assembly.
Figure 5:
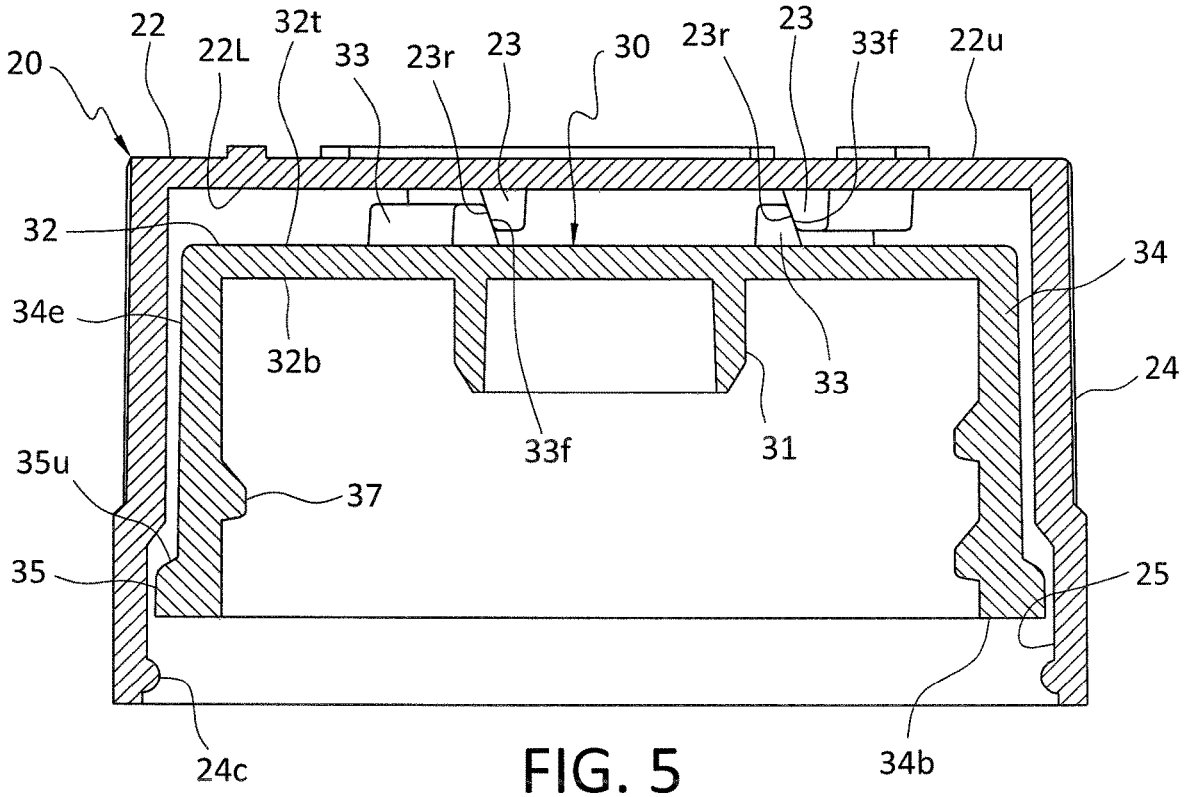
FIG. 5 shows the operation of upward and downward lugs with angled surfaces engaging one another for removal of the safety cap assembly.
Figure 6:
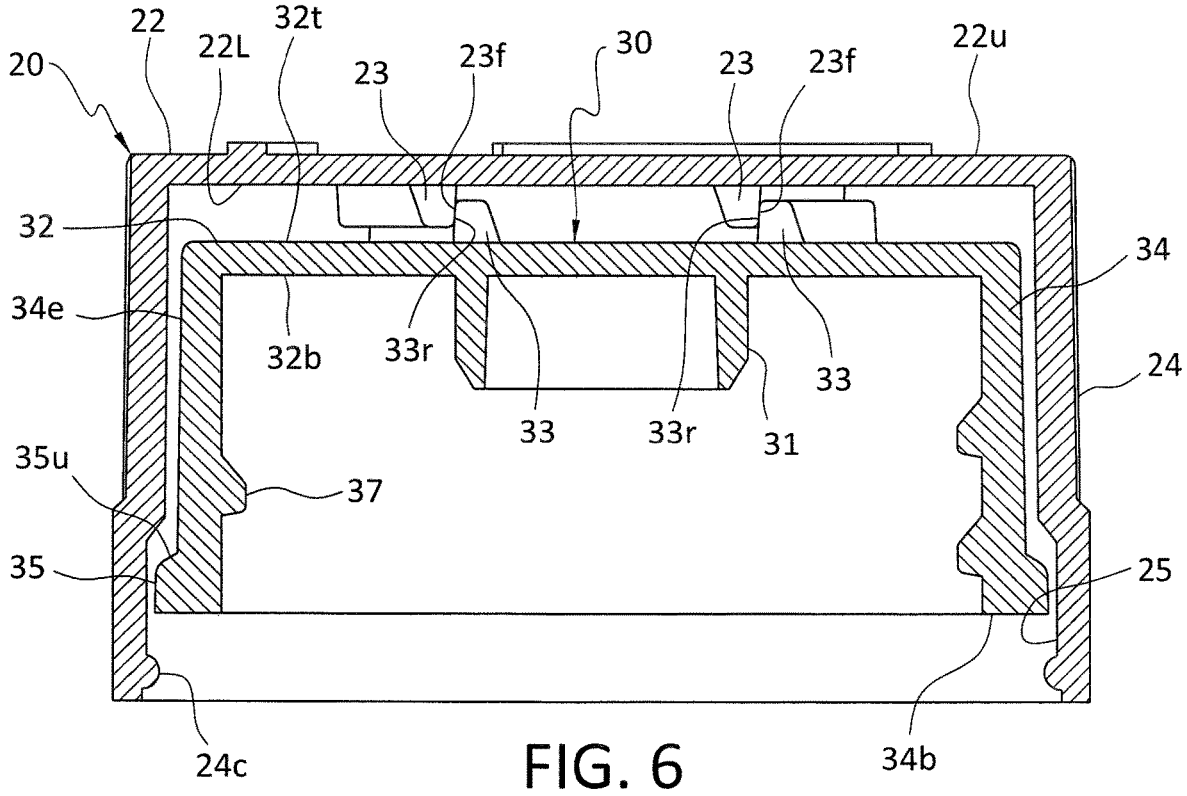
FIG. 6 shows the operation of upward and downward lugs with flat surfaces engaging one another for attachment of the safety cap assembly.
Figure 7:
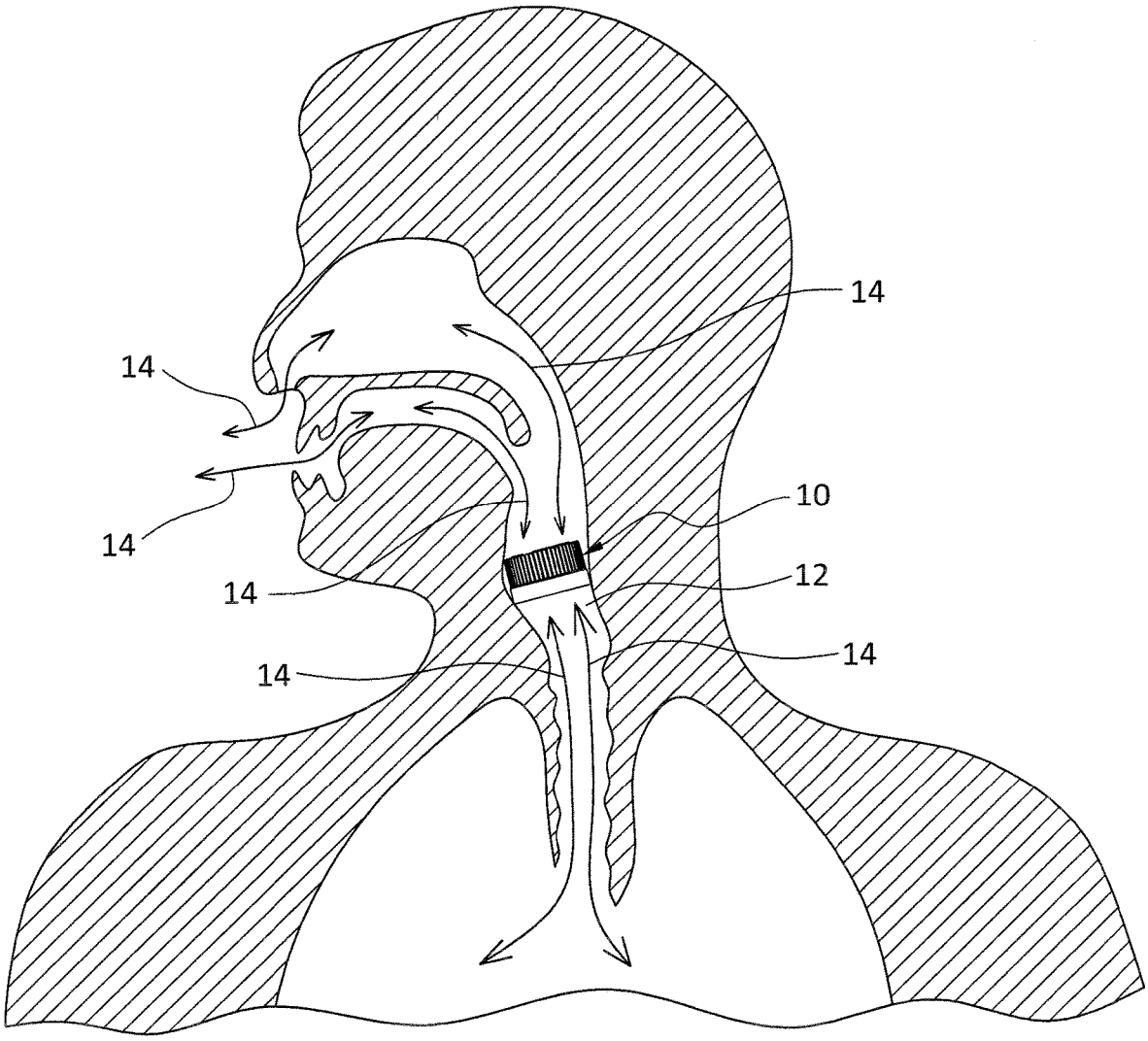
FIG. 7 shows a view of the safety cap assembly being swallowed and stuck in a human's windpipe.

As shown in FIG. 4, the safety cap assembly 10 is lodged in a human's windpipe 12. However, even when lodged air will flow through the safety cap assembly 10 as shown by the lines 14 with arrows on both ends. As shown in more detail in FIGS. 8 and 9, the air passages 26 and the air passageway 38 are in fluid communication with each other when the safety cap assembly 10 has been removed from the threaded container 100. Due to this fluid communication, suffocation is prevented should the safety cap assembly 10 accidentally be swallowed. As can been seen by the arrowed lines in FIG. 8, if the safety cap assembly 10 is swallowed with the upper wall 22 of the over cap 20 facing upward, exhaled air will travel through the air passageway 38 into first channel 40, then through second channel 42 and out to atmosphere through the arrow shaped air passages 26. Just as important, and shown by arrowed lines in FIG. 9, should the safety cap assembly 10 be swallowed with the upper wall 22U of the over cap 20 facing downward exhaled air will travel through the arrow shaped air passage 26 into the second channel 42, then through the first channel 40 and out to atmosphere through the air passageway 38. The first channel 40 which is located between the external surface 34*e* of the sidewall 34 of screw cap 20 and internal surface 24*i* of the sidewall 24 of the over cap 20 has a width of at least 0.325 mm to allow sufficient air flow through the first channel 40 should the safety cap assembly 10 accidentally be swallowed. The width of the second channel 42 located between the top surface 32*t* of screw cap 30 and the lower surface 22L of the upper wall of over cap 20 will vary as the screw cap 30 can move up and down within the over cap 20, but the width will never be less than 1.0 mm as that is the height of the upward lugs 33.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A safety cap assembly for a threaded container which prevent suffocating if swallowed and requires depressing and turning in order to be removed from the threaded container, comprising:

an over cap including an upper wall with an upper and lower surface with a plurality of spaced air passages passing from the upper surface to the lower surface of the upper wall and at least one downward lug extending downward from the lower surface, and a side wall extending downward from the top wall with an internal circumferential recess;

a screw cap including a top wall with a top and bottom surface with at least one upward lug extending from the top surface of the top wall which corresponds with the at least one downward lug in the over cap, and a side wall having internal threads, an external circumferential projection and an air passageway extending through the side wall that does not interfere with the internal threads;

the external circumferential projection of the screw cap is secure within the internal circumferential recess of the over cap such that the screw cap and the over cap can rotate relative to one another;

the air passageway in the screw cap is in fluid communication with the plurality of air passages in the over cap such that should the safety cap assembly be swallowed suffocation is prevented; and wherein when the over cap is sufficient depressed and turned the at least one downward lug will engage the at least one upward lug and the safety cap assembly can be removed from the thread container and if the over cap is not sufficient depressed the at least one downward lug will slide over the at least one upward lug and the safety cap assembly cannot be removed.

2. The safety cap assembly of claim 1, having a first channel located between the sidewall of the over cap and sidewall of the screw cap and a second channel located between the lower surface of the upper wall of the over cap and the top surface of the top wall of the screw cap that provide fluid communication between the plurality of air passages in the over cap and the air passageway in the screw cap.

3. The safety cap assembly of claim 1, wherein the plurality of air passages in the over cap are in the shape of arrows to indicate the direction the safety cap assembly needs to be turned for removal.

4. The safety cap assembly of claim 1, wherein the at least one downward lug and the at least one upward lug include angled surfaces that frictional cooperate with each other for removal of the safety cap from the threaded container.

5. The safety cap assembly of claim 4, wherein the at least one downward lug includes a flat surface which lies in a plane perpendicular to the lower surface of the over cap and opposed to the angled surfaces and the at least one upward lug includes a flat surface which lies in a plane perpendicular to the upper surface of the screw cap and opposed to the angled surfaces.

6. The safety cap assembly of claim 1, wherein the at least one downward lug includes a plurality of spaced downward lugs and the at least one upward lug includes a plurality of spaced upward lugs.

* * * * *